US005524315A

United States Patent [19]

Montabaur et al.

[11] Patent Number: 5,524,315

[45] Date of Patent: Jun. 11, 1996

[54] ROTARY BRUSH ASSEMBLY

[75] Inventors: Werner Montabaur, Königswinter; Detlef Thomas, Köln, both of Germany

[73] Assignee: Monti-Werkzeuge GmbH, Bonn, Germany

[21] Appl. No.: 277,419

[22] Filed: Jul. 18, 1994

[30] Foreign Application Priority Data

Aug. 10, 1993 [DE] Germany ..... 43 26 793.9

[51] Int. Cl.[6] ..... A46B 7/10; A46B 13/02

[52] U.S. Cl. ..... 15/179

[58] Field of Search ..... 15/23, 88.3, 88.4, 15/179, 230, 230.14, 230.16, 230.19; 451/466

[56] References Cited

U.S. PATENT DOCUMENTS 1,867,728 7/1932 Card, Jr. ..... 15/179

5,323,505 6/1994 Montabaur ..... 15/179

FOREIGN PATENT DOCUMENTS 1193384 4/1959 France ..... 15/179

3718932 12/1988 Germany .

3741983 6/1989 Germany .

413328 4/1946 Italy ..... 15/230

*Primary Examiner*—David Scherbel

*Assistant Examiner*—Randall E. Chin

*Attorney, Agent, or Firm*—Herbert Dubno

[57] ABSTRACT

A rotatable brush can have its steel bristles anchored in an endless bendable band which fits on a spacer sleeve of a holder bridging two end disks thereof. The disks can have axial ribs which are spaced from the sleeve and pass through gaps in the bristles. On these ribs or the spacer at least one axial groove is provided in which a key of the band is engaged. The key can be a clip or staple holding the ends of the band together.

12 Claims, 3 Drawing Sheets

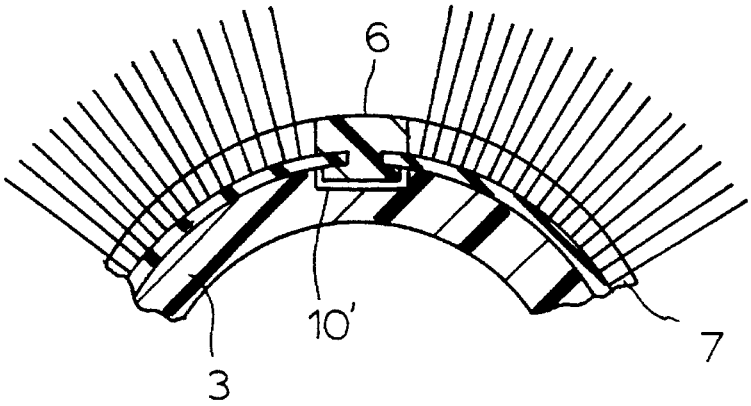
FIG. 6
FIG. 3
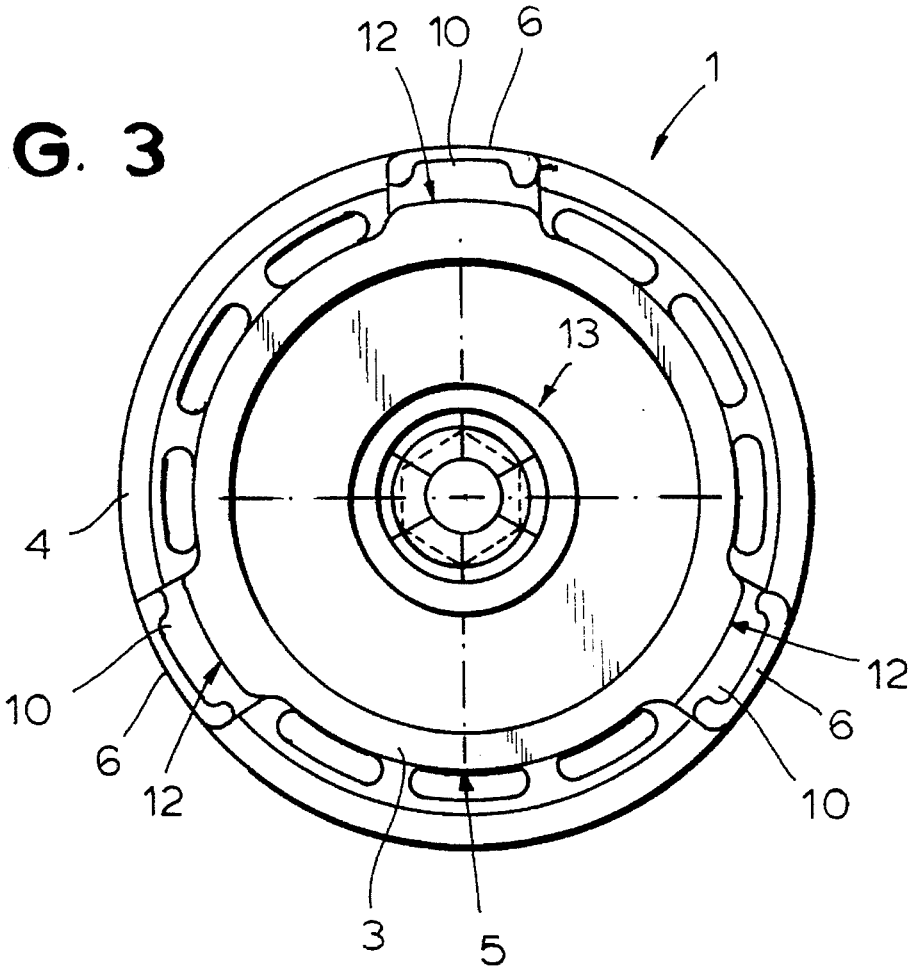

ROTARY BRUSH ASSEMBLY

FIELD OF THE INVENTION

The present invention relates to a rotary brush assembly and, more particularly, to a rotary brush assembly which comprises a pair of spaced apart disk members receiving a bristle carrier between them.

BACKGROUND OF THE INVENTION

Rotatable brush assemblies which can comprise an annular brush member and a brush carrier, can have a brush holder constituted of two end disks spaced apart by a divided spacing bushing or sleeve and axially extending ribs which are spaced from the periphery of the sleeve or bush and which retain the annular brush body between the sleeve and the ribs.

The annular brush can comprise a bendable brush band with outwardly extending bristles and formed with bristle-free zones through which the axial ribs extend.

The resulting brush can eliminate the need for a rubber core or like support and can insure effective positioning and stabilization of the annular brush body so that there will be minimum deformation of the latter resulting from assembly and a cylindrical brush surface, as the working surface will be maintained even though the brush body is composed of bendable material. Such brush assemblies, described, for example, in German Patent 3,741,983, have been found to be effective although capable of improvement.

Another tool in the form of a rotary brush which can be used for the treatment of a workpiece surface can comprise a band of plastic or metal provided with steel wire bristles of equal length. The flat, thin, endless band is placed as a ring around an elastomeric annular body and held under tension thereon by axial deformation of this body between two flanges of a tensioning unit. The axial compression applied between the flanges is transformed into a radial deformation of the support body to press outwardly against the band and tension the latter.

A problem which arises with this system is that the belt itself is not the only elastic or yieldable structure and the yielding contributed by the support may pose problems in certain applications. Such a brush structure is described in German Patent 3 718 932.

OBJECTS OF THE INVENTION

It is the principal object of the present invention to provide an improved rotatable brush assembly that has the advantages of the aforedescribed prior art devices, can afford an especially intensive and effective surface treatment of the workpiece, has a long useful life, and is free from drawbacks characterizing the earlier systems.

Another object of the invention is to provide an improved rotatable brush assembly which is inexpensive, easy to fabricate and highly effective with respect to the surface treatment of workpieces.

SUMMARY OF THE INVENTION

These objects and others which will become apparent hereinafter are attained, in accordance with the invention by providing at least one of the axial ribs on its underside or inwardly facing side with an entraining formation while the brush band or belt is provided in the region of its outer side at at least one bristle-free zone with an entrainer engageable in the aforementioned formation.

Alternatively, the periphery of the brush or sleeve can be formed with a projection engaging in the belt or the belt with a projection engaging in the periphery of the sleeve.

The brush assembly in the most generic terms, therefore, can comprise:

a brush holder comprising a pair of end disks extending generally transverse to a common axis of the disks, respective spacer sleeves projecting toward one another from the end disks and centered on the axis, the sleeves together forming an annular outer surface, and a plurality of angularly spaced axially extending ribs overhanging the annular surface and formed with at least one inner surface juxtaposed with the outer surface;

an annular brush on the brush holder, the brush comprising a bendable brush band on the outer surface inwardly of the ribs, bristles extending outwardly from the brush band beyond the ribs, and bristle-free zones along the brush band at which the ribs are disposed; and an entraining formation on one of the surfaces engaging a complementary formation at a side of the brush band juxtaposed with the one of the surfaces for rotationally coupling the brush with the holder.

In one specific configuration, the assembly can comprise:

a brush holder comprising a pair of end disks extending generally transverse to a common axis of the disks, respective spacer sleeves projecting toward one another from the end disks and centered on the axis, the sleeves together forming an annular outer surface, and a plurality of angularly spaced axially extending ribs overhanging the annular surface;

an annular brush on the brush holder, the brush comprising a bendable brush band on the outer surface inwardly of the ribs, bristles extending outwardly from the brush band beyond the ribs, and bristle-free zones along the brush band at which the ribs are disposed; and an entraining formation on an inner surface of at least one of the ribs engaging a complementary formation formed at at least an outer side of the brush band in one of the zones for rotationally coupling the brush with the holder.

In the alternative configuration, the assembly can comprise:

a brush holder comprising a pair of end disks extending generally transverse to a common axis of the disks, respective spacer sleeves projecting toward one another from the end disks and centered on the axis, the sleeves together forming an annular outer surface, and a plurality of angularly spaced axially extending ribs overhanging the annular surface;

an annular brush on the brush holder, the brush comprising a bendable brush band on the outer surface inwardly of the ribs, bristles extending outwardly from the brush band beyond the ribs, and bristle-free zones along the brush band at which the ribs are disposed; and an entraining formation on the outer surface in the form of an axially extending groove receiving an inwardly projecting formation on an inner side of the brush band for rotationally coupling the brush with the holder.

Where the annular bendable band carrying the bristles has the entrainer projecting into a groove or pocket in the rib or finger, according to the invention, the outer sleeve wall, which is otherwise cylindrical, can be provided inwardly of the axial rib with a radially extending support surface formed on or from the sleeve or bushing and providing a seat for the bristle band so that the bristle band in the region of its entrainer which is engageable in the rib pocket, can be held firmly against radial displacement and thus fixed so that the entrainer cannot release from the pocket. With this construction, moreover, no stress is applied to the band. According to the variant in which the bushing or sleeve surface is provided with an entraining pocket or recess and the entrainer is provided on the inner side of the bristle band, band slip is prevented between the spacer sleeve and the band by the engagement of the entrainer in the recess. The avoidance of relative movement between the band and the sleeve is effective for both startup and use of the brush.

In practice, the brush band is angularly fixed to the holder and thus can be retained between the end disks without being stressed upon mounting and can transfer any stresses readily to the holder.

The deformations and relative movements which have been found to occur in use or other brush assemblies utilizing an annular bristle band can thereby be avoided.

Further, there is no need for a rubber core or other elastomeric support for the annular brush body. The brush body has a diameter which is greater than that of the sleeve and with increasing speed there is increasing rotational stability of the annular brush and the progressive formation of a stiffer working cylinder capable of taking up working loads without significant deformation so that the advantages of the earlier brushes can be obtained without the drawbacks thereof. The brushing assembly of the invention has greater effectiveness in surface treatment of workpieces and the like and enhanced useful life.

When the pocket is provided in an axial rib or finger, and can be formed as in axial groove, the brush band can be provided in the bristle free zone with an axially extending key engageable in this groove so that the interaction corresponds to that of a key/groove interaction.

According to the invention, at least two angularly equispaced axial ribs and corresponding entrainers and pockets or key and groove structures are provided. More preferably at least three such ribs and respective key and groove pairs equispaced at 120° from one another are preferred.

The same distribution of key and groove pairs relates as well to the other embodiment in which an inwardly extending key-like extension is formed on the band and is engageable in an axial groove provided on the spacer sleeve. It will be apparent that in this latter embodiment the axial key need not be disposed in a bristle free zone of the band but can be offset from a bristle free zone, since the key is on the inner side of the band.

The axial or each axial key can be formed by metal clips or staples engaged in the brush band and can, for example, be the clip or staple which joins two ends of the band together into annular or endless structure. Of course, the metal clips or staples can also be provided in the bristle free regions as desired.

The brush holder can be divided in a median plane so that both the spacer sleeve and the axial ribs are so divided and meet at the central plane of the holder. The two inner halves may then be clamped together on a center drive shaft.

Indexing or engaging formations on the two halves may hold them together in abutting relationships. The brush holder halves can be held together also independently of the central drive shaft or via a central clamping screw after assembly of the two halves and the annular brush together. According to a feature of the invention, the two brush halves are composed of plastic which can be recyclable and has an elastic property in the formation of a deposited brush assembly. While the invention can also allow separation of the brush halves for replacement of the brush body as is common with earlier metal rotary brush units, the invention permits fabrication of the brush support halves from plastic in a disposable version or to reuse after replacement of the work brush body.

BRIEF DESCRIPTION OF THE DRAWING

The above and other objects, features, and advantages will become more readily apparent from the following description, reference being made to the accompanying drawing in which:

FIG. 3 is an end view from the interior of one of the brush holder halves;

FIG. 6 is a detail section illustrating the alternative embodiment.

SPECIFIC DESCRIPTION

Figure 1:
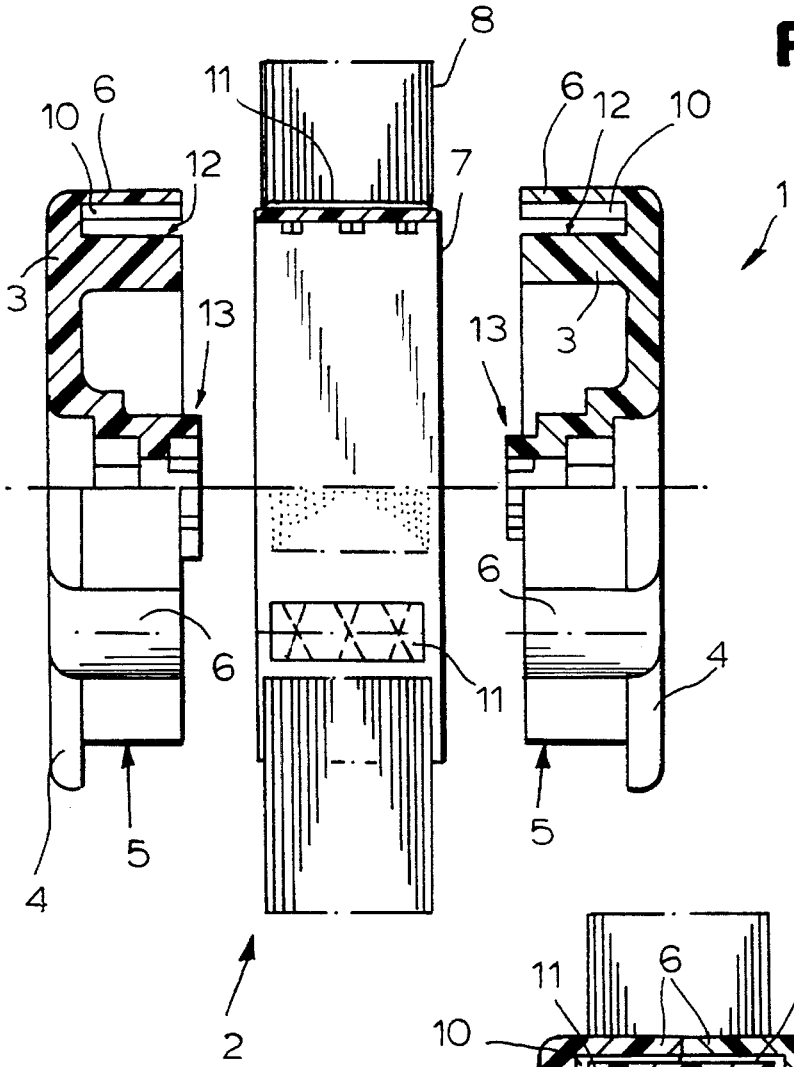
FIG. 1 is an exploded view, partly in section, diagrammatic illustrating the brush assembly of the invention.
Figure 2:
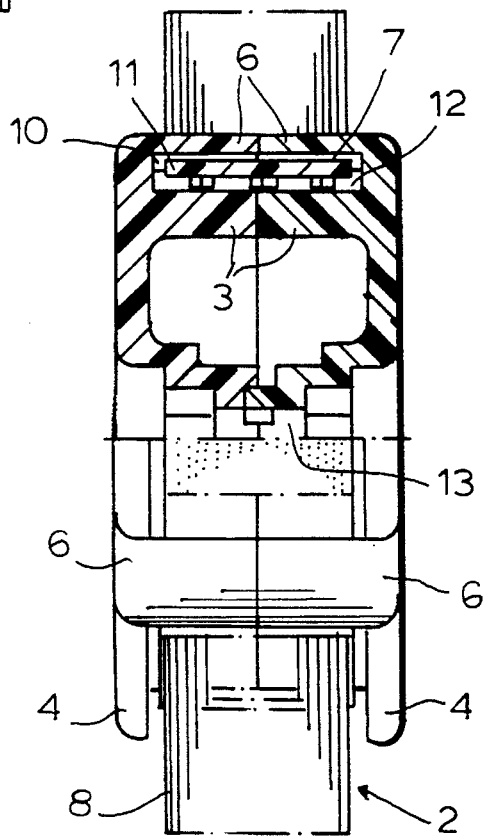
FIG. 2 is an elevational view partly broken away and partly in cross section of the assembled brush.

In the drawing, we have shown a rotatable brush assembly which basically comprises a brush holder 1 and an annular brush body 2. The brush holder 1 comprises two end disks 4 spaced apart by a divided spacing sleeve 3, i.e. two spacing sleeve halves which abut one another in the longitudinal median plane of the holder. The disks 4 are formed, at a slight spacing outwardly of the cylindrical wall 5 of the spacer sleeve 3, with a plurality of angularly equispaced axial ribs 6 which are also divided at the median plane.

Figure 4:
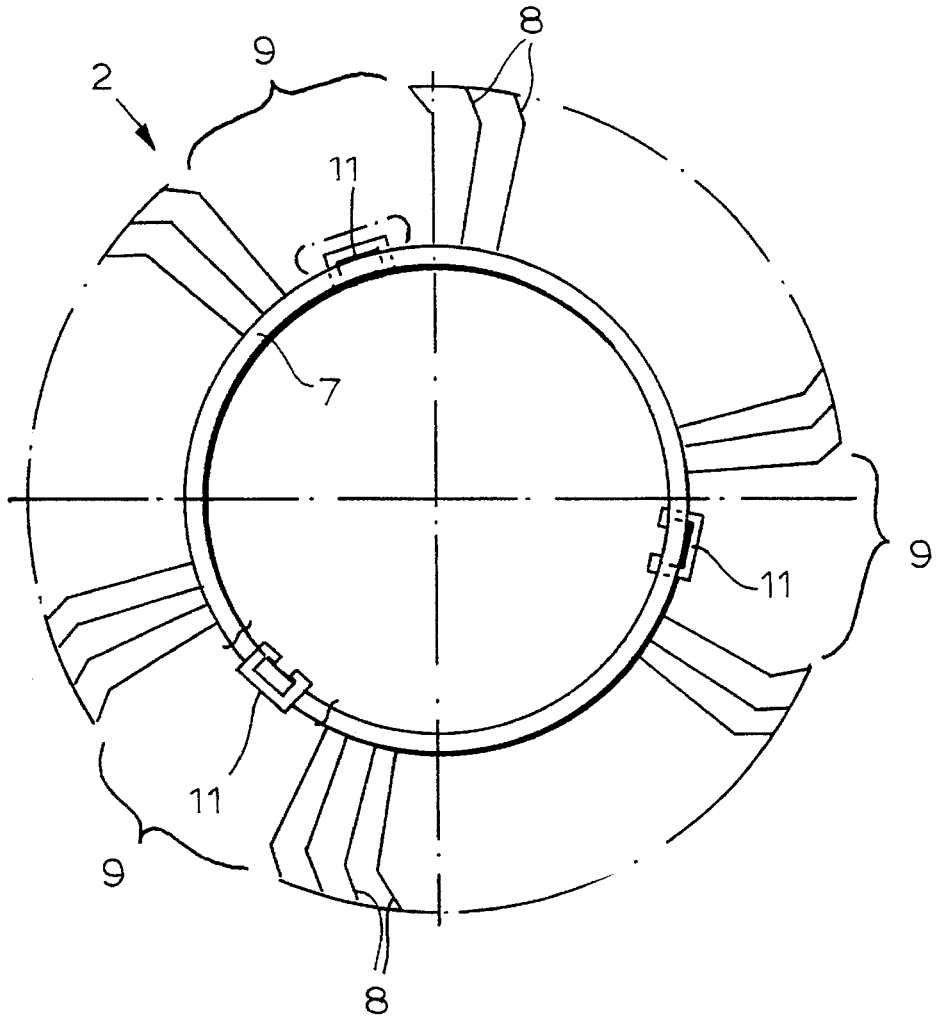
FIG. 4 is a diagrammatic elevation of an annular brush body for use in the system of FIG. 1.

The annular brush body 2 comprises a bendable brush band 7 of a width W slightly less than the axial length L of the wall 5 and is formed with outwardly projecting bristles 8, e.g. U-shaped steel bristles whose bights or bases are anchored in the band 7. The brush body has bristle free zones 9 (FIG. 4) through which the axial rib 6 can pass when the housing or holder 1 is assembled on the brush body 2.

Figure 5:
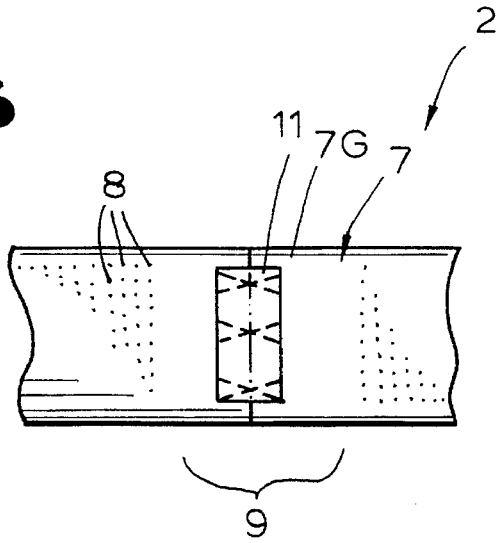
FIG. 5 is a bristle free zone of an annular brush provided with a metal clip as the key.

In the embodiment illustrated in FIGS. 1 through 5, the axial ribs 6 are formed on their respective inner sides, with axially extending grooves forming entraining pockets or recesses 10. The band 7 is provided on its exterior with entrainers 11 which constitute keys engageable in the pockets or recesses 10 and are anchored to the band in the bristle free zones. These retainers can be clips or clamps and one of them, as shown in FIG. 5, can hold ends **7*a* and 7*b* of the band 7** together in an endless belt or ring.

The wall 5 of the spacer sleeve may have a radially projecting support surface 12 for the band 7. The support surfaces 12 are radially inwardly of the ribs 6.

The band 7 may be a plastic: reinforced fabrication or a fabrication reinforced plastic and the members 11 may be metal clips or staples.

The two halves of the holder 1 may be affixed together on a central drive shaft or with a clamping screw (not shown) or may have a groove and projection lock 13 which may form a bayonet connection clamping the two halves together. The brush halves may be composed of metal or plastic. The divided ribs can have abutting surfaces with locking means holding the halves together.

As can be seen in FIG. 6, in an alternative embodiment, the axial grooves 101 may be formed in the wall 5 of the spacer 3 and the clips 11 may extend inwardly from the band 7 to form a key in each of the grooves.

We claim:

1. A rotatable brush assembly, comprising:

a brush holder comprising a pair of end disks having a common axis, extending generally transverse to said common axis, respective spacer sleeves projecting toward one another from said end disks and centered on said axis, said sleeves together forming an annular outer surface, and a plurality of angularly spaced axially extending ribs overhanging said annular outer surface and formed with at least one inner surface juxtaposed with said outer annular surface;

an annular brush on said brush holder, said brush comprising a bendable brush band on said annular outer surface inwardly of said ribs, bristles extending outwardly from said brush band beyond said ribs, and bristle-free zones along said brush band at which said ribs are disposed, said ribs entraining said brush rotatably with said brush holder; and an entraining formation on one of said surfaces, said brush band having a side juxtaposed with said one of said surfaces and provided with a complementary formation engaged by said entraining formation for rotationally coupling the brush with the holder.

2. A rotatable brush assembly, comprising:

a brush holder comprising a pair of end disks having a common axis, said end disks extending generally transverse to said common axis of said disks, respective spacer sleeves projecting toward one another from said end disks and centered on said axis, said sleeves together forming an annular outer surface, and a plurality of angularly spaced axially extending ribs overhanging said annular outer surface;

an annular brush on said brush holder, said brush comprising a bendable brush band on said annular outer surface inwardly of said ribs, said brush band having an outer side, bristles extending outwardly from said brush band beyond said ribs, and bristle-free zones along said brush band at which said ribs are disposed, said ribs entraining said brush rotatably with said brush holder, at least one of said ribs having an inner surface; and an entraining formation on said inner surface of said one of said ribs engaging a complementary formation formed on said outer side of said brush band in one of said zones for rotationally coupling the brush with the holder.

3. The assembly defined in claim 2 wherein at least one of said ribs has an axial groove constituting said entraining formation, said assembly further comprising an axial key in a respective one of said zones of said brush.

4. The assembly defined in claim 3 wherein said annular outer surface is provided with radially extending support surfaces juxtaposed with said ribs and engaging said brush band.

5. The assembly defined in claim 2 wherein said holder is centrally divided into two halves, each of said halves being formed with half of each of said ribs, said holder being traversed by means for holding said halves together.

6. The assembly defined in claim 5 wherein said means for holding said halves together include a central shaft traversing said holder.

7. The assembly defined in claim 5 wherein said halves are molded unitarily from a synthetic resin.

8. A rotatable brush assembly, comprising:

a brush holder comprising a pair of end disks having a common axis, said end disks extending generally transverse to said common axis, respective spacer sleeves projecting toward one another from said end disks and centered on said axis, said sleeves together forming an annular outer surface, and a plurality of angularly spaced axially extending ribs overhanging said annular outer surface;

an annular brush on said brush holder, said brush comprising a bendable brush band on said annular outer surface inwardly of said ribs, bristles extending outwardly from said brush band beyond said ribs, and bristle-free zones along said brush band at which said ribs are disposed, said ribs entraining said brush rotatably with said brush holder, said brush band having an inner side provided with an inwardly projecting formation; and an entraining formation on said annular outer surface in the form of an axially extending groove receiving said inwardly projecting formation on said inner side of said brush band for rotationally coupling the brush with the holder.

9. The assembly defined in claim 8 wherein a plurality of said axial grooves are spaced around said outer surface and said brush band has a number of inwardly projecting formations equal to the number of grooves and at an angular spacing corresponding to a spacing of said grooves for engaging said formations in said grooves.

10. The assembly defined in claim 9 wherein said holder is centrally divided into two halves, each of said halves being formed with half of each of said ribs, said holder being traversed by means for holding said halves together.

11. The assembly defined in claim 10 wherein said means for holding said halves together include a central shaft traversing said holder.

12. The assembly defined in claim 10 wherein said halves are molded unitarily from a synthetic resin.

* * * * *